United States Patent [19]
Markham et al.
[11] 4,363,697
[45] Dec. 14, 1982

[54] METHOD FOR MEDIUM CONSISTENCY OXYGEN DELIGNIFICATION OF PULP

[75] Inventors: Larry D. Markham, Pierrefonds, Canada; Henrik J. Eklund, Middletown, Ohio

[73] Assignees: The Black Clawson Company, Middletown, Ohio; Air Products and Chemicals, Inc., Allentown, Pa.

[21] Appl. No.: 99,684

[22] Filed: Dec. 3, 1979

[51] Int. Cl.[3] ..... D21C 9/10

[52] U.S. Cl. ..... 162/19; 162/57; 162/65; 162/241; 162/243

[58] Field of Search ..... 162/17, 19, 25, 237, 162/57, 90, 241, 243; 8/116 R, 111; 422/229

[56] References Cited

U.S. PATENT DOCUMENTS

| | | | |
|---|---|---|---|
| 1,433,865 | 3/1922 | Wolf | 162/59 |
| 2,953,202 | 9/1960 | Green | 162/237 |
| 3,313,677 | 4/1967 | Carr | 162/19 |
| 3,754,417 | 8/1973 | Jamieson | 162/65 |
| 3,963,561 | 6/1976 | Richter | 162/65 |
| 3,966,542 | 6/1976 | Oldshue | 162/57 |
| 4,088,528 | 5/1978 | Berger et al. | 162/19 |
| 4,198,266 | 4/1980 | Kirk et al. | 162/65 |
| 4,248,662 | 2/1981 | Wallick | 162/65 |
| 4,259,150 | 3/1981 | Prough | 162/65 |

FOREIGN PATENT DOCUMENTS

| | | | |
|---|---|---|---|
| 929711 | 7/1973 | Canada | 162/65 |
| 53-31964 | 9/1978 | Japan | 162/65 |
| 818828 | 8/1959 | United Kingdom . | |
| 2006852 | 5/1979 | United Kingdom . | |

OTHER PUBLICATIONS

Yrjala et al, "New Aspects of Sulphate Pulp Bleaching", *Pulp & Paper Canada,* vol. 79, No. 4, Apr. 1978, pp. 132–135.

Hasvold; "Waste Utilization–Oxygen Delignification of Sulfite knots", 1978, International Sulfite Conf., Montreal, Canada, Sep. 13, 1978.

Annergren, "Medium Consistency Oxygen Bleaching . . . ", 1979 Pulp Bleaching Conf., Toronto, Canada, Jun. 11–14, 1979, pp. 99–105.

Eachus "Atmospheric–Pressure Oxygen Bleaching", *TAPPI,* vol. 58, No. 9, Sep. 1975, pp. 151–154.

Saukkonen et al, "Soda–Oxygen Pulping of Pinewood for Different End Products", *TAPPI,* vol. 58, No. 7, Jul. 1975, pp. 117–120.

Chang et al, "Delignification of High–Yield Pulp with Oxygen and Alkali", *TAPPI,* vol. 56, No. 1, Jan. 1973, pp. 97–100.

Chang et al, "Delignification of High–Yield Pulps with Oxygen and Alkali", *TAPPI,* vol. 57, No. 5, May 1974, pp. 123–126.

*Paper Trade Journal,* Nov. 15–30, 1978, p. 32.

*Primary Examiner*—Steve Alvo
*Attorney, Agent, or Firm*—Biebel, French & Nauman

[57] ABSTRACT

Medium consistency oxygen delignification of pulp is carried out in a series of tubular reaction zones. Rapid delignification is achieved by agitating the pulp by rotating a timing screw in the first reaction zone at a speed in excess of 10 rpm, modifying the flights on the timing screw to increase the amount of agitation, or a combination of the two. Primary oxygenation is carried out in the first reaction zone while subsequent zones provide the retention time needed for the delignification reaction to go to completion. A thick stock pump is used to introduce the pulp into the first reaction zone.

13 Claims, 5 Drawing Figures

FEED
STEAM
14
16
THICK STOCK PUMP
12
ALKALINE LIQUOR
20
24
22
10
STEAM
46
OXYGEN GAS
18
23
D
34
32
30
STEAM
48
18a
OXYGEN GAS
33
D
44
42
40
50
STEAM
18b
OXYGEN GAS
43
D
54
56

METHOD FOR MEDIUM CONSISTENCY OXYGEN DELIGNIFICATION OF PULP

BACKGROUND OF THE INVENTION

This invention relates to delignifying pulp in the presence of oxygen, and more particularly to a process for oxidative delignification of a medium consistency pulp using a series of tubular reaction zones.

Conventional processes for chemical pulping of fibrous raw materials have in the past utilized sulfur-containing compounds while conventional bleaching processes have utilized chlorine containing compounds. Today, environmental considerations have resulted in a search for nonpolluting processes which can offer the desired pulp yields and qualities. Much attention has been devoted to the use of oxygen in combination with alkaline chemicals to delignify pulp.

For example, several workers have investigated oxygen delignification of high consistency pulp (i.e., 20–30% consistency). See, Eachus, TAPPI Volume 58, p. 151–154 (September 1975) and Hasvold, 1978 International Sulfite Conference, Montreal, Canada (Sept. 13, 1978). Other workers have utilized oxygen delignification in low consistency (i.e., 1–5% consistency) pulping or bleaching processes. See, Paper Trade Journal p. 37–39 (July 15, 1978).

However, both of these processes suffer from several disadvantages. Low consistency operation requires a large reactor volume to maintain an acceptable retention time for the pulp. Operating at low consistency also produces large power demands for pumping large volumes of pulp and a high steam usage to heat the pulp in the reactor. Additionally, the low concentrations of dissolved solids in the spent liquor increases evaporation costs for chemical recovery processes. Operation at high consistency, on the other hand, usually requires special dewatering equipment to attain the higher consistency. It is also known that high consistency operation of an oxygen delignification system can result in overheating of the pulp due to the exothermic delignification reaction, as well as pulp degradation and even combustion of the pulp.

Carrying out oxygen delignification of pulp at medium consistency (i.e. 8–20% consistency) would be advantageous in that much existing mill equipment, including pulp washing and thickening equipment, is designed to operate in that consistency range and no special equipment would be required to attain that range. Markham et al, in copending application Ser. No. 072,796, filed Sept. 5, 1979 utilize a medium consistency system to delignify pulp mill rejects. Some workers have reported satisfactory results operating at medium consistency on a laboratory scale using rotary autoclaves with no internal means of mixing (See, e.g., Annergren et al, 1979 Pulp Bleaching Conference, Toronto, Canada, June 11–14, 1979; Saukkonen et al, TAPPI Volume 58, p. 117 (1975); and Chang et al, TAPPI Volume 56, p. 97 (1973)). However, such equipment is not suitable for scale-up to handle large tonnages of pulp on a commercial scale. Other workers have encountered serious problems even on a small laboratory scale. For example, Eachus, TAPPI Volume 58, p. 151 (1975), reported that oxygen delignification at medium consistency was not practical because of a high alkali requirement, oxygen starvation, and a limited delignification.

Chang et al, TAPPI Vol. 57, p. 123 (1974), concluded that operation at medium consistency produced a considerably lower delignification rate than high consistency operation and also resulted in nonuniform delignification. Although the authors suggested that these problems could be overcome through the use of higher oxygen pressures in the reaction vessel, use of such higher pressures has several disadvantages. These include greater costs for a thicker-walled reaction vessel, greater difficulty in feeding pulp against the higher pressure, and an increased danger of gas leakage. Vertical tube oxygen reactors operating at medium consistency have been constructed for trial purposes. (See Annergren et al, 1979 Pulp Bleaching Conference, Toronto, Canada, June 11–14, 1979, and Kleppe et al, TAPPI Vol. 59, p. 77 (1976).) However, such vertical tube designs have serious deficiencies, including channeling of gas and pulp up through the tower and also the requirement for a high speed mechanical mixer to disperse oxygen into the pulp slurry. Such high speed mixing can lead to pulp degradation and additionally requires substantial power input.

As can be seen, there is a need in the art for a simple and efficient process for oxygen delignification of medium consistency pulp which avoids the problems which have plagued the prior art.

SUMMARY OF THE INVENTION

The present invention meets this need by providing a process utilizing tubular reaction zones which produce rapid oxygen delignification rates at low alkali charges, uniform delignification, and high pulp strength. Use of timing screws in the reaction zones enables both good mixing of oxygen with the medium consistency pulp as well as controlling pulp retention time at each stage of the delignification reaction.

In accordance with the invention, pulp is introduced into a first tubular reaction zone where it undergoes a primary oxygenation treatment. A thick stock pump is used to feed the pulp into the reaction vessel. Use of the thick stock pump prevents the loss of gas pressure from the vessel and does not severely compact the pulp so that uniform oxygenation and delignification can occur.

Oxygen may be introduced into the delignification system either at one injection point or multiple injection points. Typically, oxygen gas will be injected on the lower side of the reaction vessel. Partially spent gas may, optionally, be removed from the delignification system by venting to the atmosphere or it may be collected for recycle. Additionally, the partially spent gas may be drawn off and utilized for lime kiln enrichment, waste water treatment, or other suitable uses. Any organic compounds or carbon monoxide formed during the delignification reaction may be removed by passing the gas through a catalyst bed before reuse.

Alkaline pulping chemicals are also introduced into the first reaction zone to aid in the delignification. Examples of such alkaline chemicals which are suitable for use in the practice of the present invention include sodium hydroxide, sodium carbonate, sodium borate compounds, ammonia, oxidized kraft white liquor, and mixtures thereof. Preferably, at least a portion of the total charge of alkaline chemicals is added to the pulp prior to its passage through the thick stock feed pump into the first reaction zone. This insures that the pulp has an alkaline pH when the pulp enters the first reaction zone and also lubricates the pulp for easier pumping. An additional portion of the total charge is added to the first reaction zone from one or more injection points along the top of the vessel. Magnesium sulfate or other known protector chemicals or catalysts for preserving the viscosity and strength of the pulp may be introduced into the pulp either before or after the thick stock feed pump.

Steam is also added to the pulp prior to its entry into the thick stock feed pump. The steam aids in expelling excess air from the pulp prior to delignification. Additional steam may be injected into the reaction vessel as needed in order to maintain the desired reaction temperature, although the exothermic delignification reaction supplies a substantial fraction of the heat requirement.

As the pulp at 8–20% and preferably 10–15% consistency is introduced into the first reaction zone through the thick stock pump, a timing screw agitates the pulp, oxygen, and alkaline chemical mixture. It has been found that a timing screw extending the entire length of the reaction zone produces the mixing necessary for uniform delignification. Various modifications can be made to the design of the timing screw to improve the mixing of the pulp. Modifications to the screw design may consist of using cut flights, cut and folded flights, bent flights, ribbon flights, paddle flights, cut flights with paddles, solid flights with paddles, or paddles in combination with cut and folded flights.

It has further been found that adjustment of the speed of rotation of the timing screw can be used as an alternative or addendum to the modification of the screw design in order to achieve uniform delignification. Rotation speeds in the first reaction zone of between 10 and 200 rpm yield satisfactory mixing. Of course, the faster the speed of screw rotation, the less the retention time of the pulp in the first reaction zone. Thus, uniform delignification in the first reaction zone can be achieved according to the practice of the present invention by the use of timing screw speeds of from 10 to 200 rpm, by modification of the screw design, or by a combination of the two.

A substantial portion of the delignification occurs in the first reaction zone after which the mixture of pulp, oxygen, and alkaline chemicals is passed to a secondary reaction zone. There, the mixture is agitated much less vigorously, i.e., using a mixing speed of 0.5 to 5 rpm, and delignification proceeds further. Optionally, a nonagitated vertical vessel may be used for a final reaction zone.

The oxygen delignification system of the present invention can be used to delignify any type of pulp including mechanical pulps, thermomechanical pulps, semichemical or modified mechanical pulps, chemical pulps, and secondary fiber. Additionally, nonwood fibers such as straw, flax, and bagasse can also be delignified by the practice of the present invention. The reaction temperature, alkali charge, type of alkaline chemical, oxygen partial pressure, and retention time depend on the type of material being treated and the desired degree of delignification. Typically, temperatures may range from 80° to 160° C., alkaline chemical charges from 1 to 20% calculated as $Na_2O$ on oven dry material, and oxygen partial pressures from 30 to 200 psi. Appropriate retention times have been found to be 5 to 120 minutes.

Accordingly, it is an object of the present invention for uniformly and rapidly delignifying pulp at medium consistencies while avoiding the problems of nonuniform delignification and slow reaction rates which plagued the prior art. This and other objects and advantages of the invention will become apparent from the following description, the accompanying drawings, and the appended claims.

DESCRIPTION OF THE PREFERRED EMBODIMENTS

Figure 1:
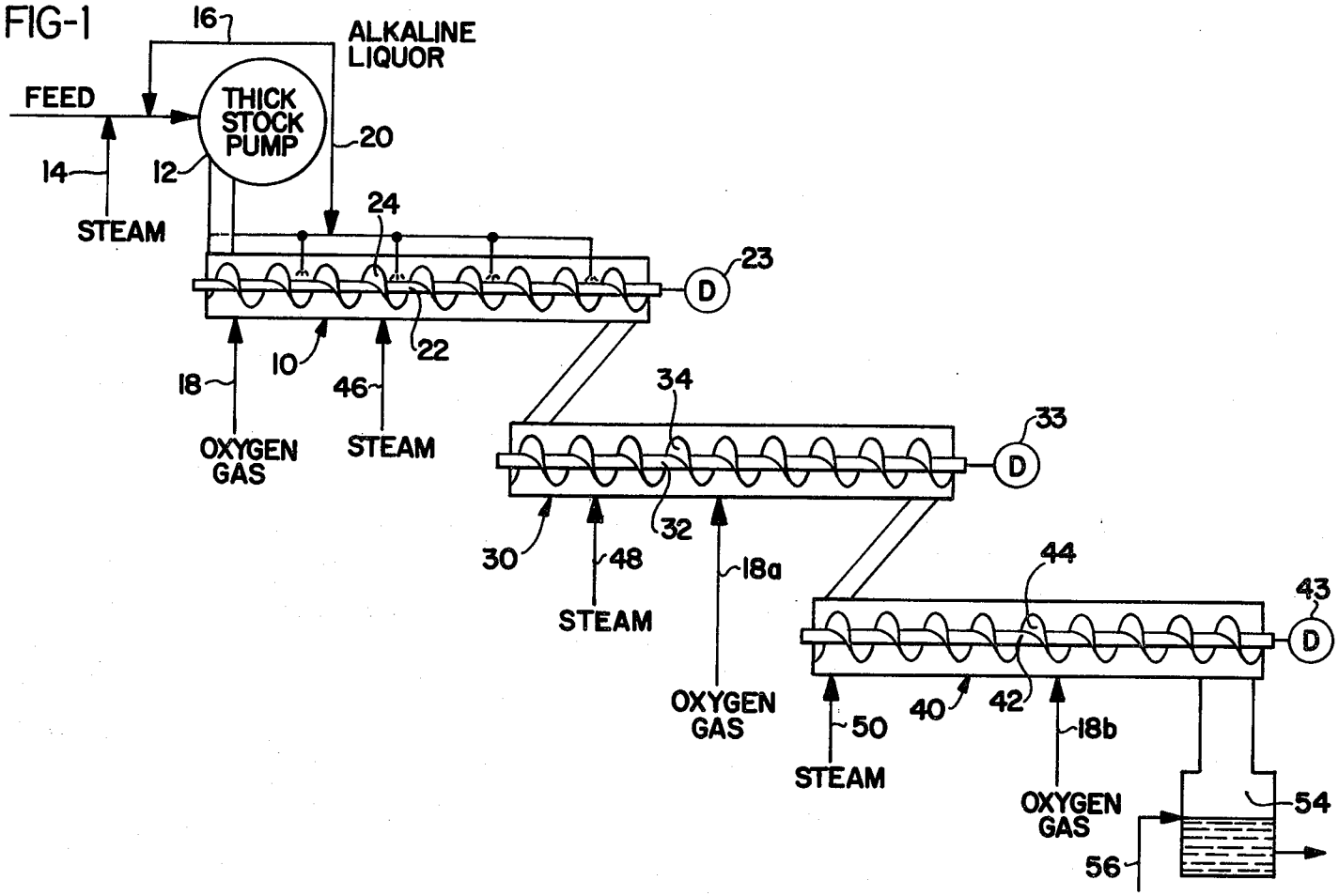
FIG. 1 is a schematic flow diagram illustrating the overall process of the present invention; and FIGS. *2a–2d* illustrate various modified screw flight designs found to be satisfactory for the practice of the present invention.

As illustrated in FIG. 1, pulp at from 8–20% consistency and preferably 10–15% consistency is introduced into a first horizontal reaction tube 10 by a thick stock pump 12. Inclined reaction tubes may also be employed, but the angle of incline should not exceed approximately 45 degrees to avoid compression and dewatering of the pulp in the lower end of the tube, which will interfere with uniform mixing of oxygen. The reaction tubes should therefore be substantially horizontal except for the first reaction zone which, because of a relatively short residence time, may comprise a vertical tube. Additionally, while the reaction vessel is illustrated as a series of substantially cylindrical reactor tubes, a single vessel having a series of reaction zones or non-cylindrical tubes such as a twin-screw system may be utilized.

Pump 12 may be a Moyno progressing cavity pump available from Robbins & Myers, Inc., Springfield, Ohio. Alternatively, pump 12 may be a Cloverotor pump available from the Impco Division of Ingersoll-Rand Co., Nashua, New Hampshire, or a thick stock pump manufactured by Warren Pumps, Inc., Warren, Massachusetts.

It has been found that these pumps are capable of feeding the pulp into the reaction tube against the pressure in that tube without severely compacting the pulp and without any gas losses from the tube. Other feeding devices such as rotary valves or screw feeders are not desirable for use in this invention. A rotary valve allows substantial gas loss from the reaction tube due to the rotation of valve sections which are alternately exposed to the high oxygen pressure in the reactor and then to atmospheric pressure external to the reactor. Use of a screw feeder results in the severe compression and dewatering of pulp so that efficient oxygenation at the proper consistency range cannot occur.

Prior to introducing the pulp into thick stock pump 12, steam may be injected into the pulp via line 14. The steam aids in expelling excess air from the pulp and also raises the temperature of the pulp somewhat. Additionally, it is desirable to add at least a portion of the total amount of the charge of alkaline material prior to the introduction of the pulp into thick stock pump 12. This addition of alkaline material can be made through line 16. The alkaline material serves to lubricate the pulp for easier pumping as well as to insure that the pulp will have an alkaline pH when it enters reaction tube 10. Alternatively, all of the charge may be added at this point.

Generally, the total alkaline material charge will amount to from 1 to 20% by weight calculated as $Na_2O$ of the oven dry weight of the raw fibrous material. Examples of alkaline materials suitable for use in this invention include sodium hydroxide, sodium carbonate, sodium borate compounds, ammonia, oxidized kraft white liquor, and mixtures thereof although other known alkaline pulping liquors may also be used.

Once introduced into reaction tube 10, the pulp undergoes a primary oxygenation treatment. Oxygen gas is introduced into reaction tube 10 through line 18. Alternatively, oxygen may be introduced at a number of points along the length of tube 10. Typically, the oxygen partial pressure maintained in the system is from about 30 to 200 psig.

Spent gas may be removed from the system by venting it to the atmosphere. Alternatively, it may be recovered for recycle to the reaction tubes or may be used for other purposes such as lime kiln enrichment or waste water treatment. Any organic vapors or carbon monoxide produced during the delignification reaction can be removed by passing the gas through a catalyst bed.

Primary oxygenation is carried out by mixing the pulp, oxygen, and alkaline liquor which is injected through line 20 and sprayed over the pulp along the length of the tube. By adding the alkaline liquor gradually along the length of the tube rather than all at once as is conventional in high consistency (i.e., 20–30% consistency) oxygen delignification, better pulp viscosity and strength is achieved. Another advantage to gradually adding the alkaline liquor is that the exothermic delignification reaction is more easily controlled and the risk of localized overheating is diminished.

Satisfactory mixing can be achieved either by rotating timing screw 22 with drive means 23 at a rate in excess of 10 rpm (preferably 10–200 rpm), modifying the flights on the screw, or a combination of the two. Typically, the primary oxygenation is completed within 20 seconds to 10 minutes, and preferably within 1 to 5 minutes. As shown in FIG. 1, screw 22 may have a solid helical flight design 24. Alternatively, other modified flight designs may be utilized including cut flights, cut and folded flights, bent flights, ribbon flights, paddle flights, cut flights with paddles, or solid flights with paddles. Solid flight designs are preferred due to their better mechanical strength as opposed to ribbon flights. Alternatively, satisfactory mixing can be achieved by modifying only a portion of the screw flight in a primary oxygenation zone within a single reaction vessel.

Figure 2A:
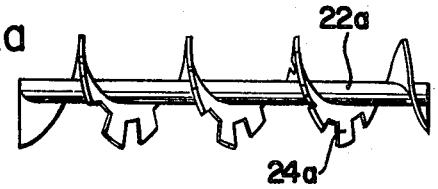
Figure 2B:
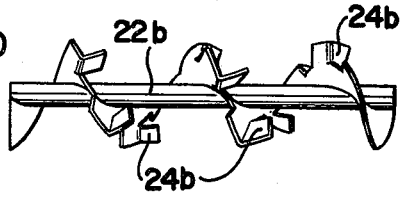
Figure 2C:
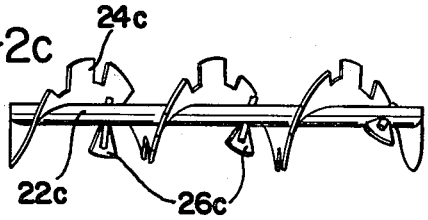
Figure 2D:
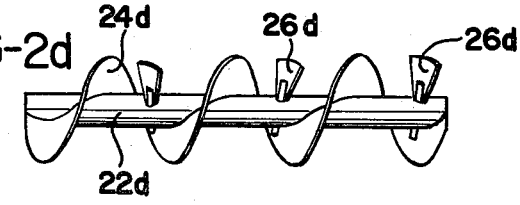

As illustrated in FIG. 2*a*, a screw 22*a* having cut flights 24*a* may be utilized in the practice of the invention. FIG. 2*b* shows a screw 22*b* having cut and folded flights 24*b*. FIG. 2*c* shows a screw 22*c* having cut flights 24*c* in combination with paddles 26*c*. Finally, FIG. 2*d* illustrates a screw 22*d* having solid flights 24*d* in combination with paddles 26*d*.

These alternative flight designs produce a greater degree of mixing as the pulp is advanced along the length of the reaction tube than a standard solid flight screw. Thus, in some cases, this enhanced mixing action is sufficient to achieve uniform, rapid delignification without the need for rapid rotation of the screw. In other cases where a large amount of delignification is required, such as for example a 50 Kappa number unit decrease, a combination of the modified screw flight design in both the first and subsequent reaction tubes and high rotation rate in the first reaction tube may be required.

Where the primary oxygenation treatment is carried out by driving screw 22 in first reaction tube 10 at speeds between 10 and 200 rpm, the use of one or more additional reaction tubes may be required to permit a sufficient retention time in the system to allow the delignification reaction to proceed to the desired Kappa number. As shown in FIG. 1, these subsequent reaction tubes 30 and 40 are of a design similar to the first reaction tube. Suitable drive means 33 and 43 rotate screws 32 and 42 with flights 34 and 44, respectively. Preferably, the screws are rotated at speeds less than 5 rpm to provide longer retention times. Additionally, tubes 30 and 40 have larger diameters than tube 10 to accomodate the greater volume of pulp which results from the more rapid passage of pulp through tube 10. The relative sizing of the respective reaction tubes can be easily calculated based on the relative rotational rates of the screws therein. Preferably, the system is operated so that each reaction tube operates at about 70% capacity. Oxygen can be added to reaction tubes 30 and 40 through lines 18*a* and 18*b*. Optionally, a nonagitated vertical tube (not shown) may be used as the final reaction vessel. Total retention times of the pulp in the system may vary depending upon the nature and condition of the pulp and the desired amount of delignification to be accomplished. Retention times of between 5 and 120 minutes have been found to be satisfactory.

Steam is injected at one or more points in the system to maintain the temperature in the reaction tubes within the preferred 80°–160° C. temperature range. As shown in FIG. 1, steam is injected through lines 46, 48, and 50 into tubes 10, 30, and 40, respectively.

Upon completion of the delignification reaction, the pulp is passed to a cold blow region 54 where it is contacted with dilution liquor from line 56. The pulp is discharged using a conventional blow wiper discharger.

The oxygen delignification system of the present invention can be used on any type of pulp including mechanical pulps, thermomechanical pulps, semichemical or modified mechanical pulps, chemical pulps, and secondary fiber. It can also be used on nonwood fibers such as straw, bagasse, or flax.

The present invention may be better understood by reference to the following nonlimiting examples.

EXAMPLE I

A sample of unbleached softwood kraft pulp having a Kappa number of 31.0 was delignified using oxygen and alkali at a dosage of 3.0% by weight NaOH based on oven dry pulp. The pulp was placed in a horizontal tube oxygen reactor in a compacted form similar to the state of the pulp as it is discharged from a thick stock pump. The consistency of the pulp was 10% solids, the total reaction pressure was 110 psig, and the total reaction time of the pulp with oxygen was 15 minutes at a temperature of 110° C. Three separate runs were performed under the above conditions with Run 1-A having no agitation. In Run 1-B the pulp was agitated with a modified screw design in accordance with the present invention, namely by means of a horizontal shaft with paddles extending through the reactor and turning at 1 rpm. In Run 1-C, the pulp was agitated with the shaft and paddles of Run 1-B turning at 20 rpm for the first 2 minutes and at 1 rpm for the final 13 minutes of the reaction. The results are reported in Table I below.

TABLE I

| | Kappa No. | Change in Kappa No. | Final pH |
|---|---|---|---|
| Starting pulp | 31.0 | — | — |
| Run 1-A | 25.7 | 5.3 | 12.0 |
| Run 1-B | 22.2 | 8.8 | 11.7 |
| Run 1-C | 21.0 | 10.0 | 11.6 |

As can be seen, even for relatively short reaction times and relatively small amounts of delignification, practice of the process of the present invention yields superior results.

EXAMPLE II

A sample of refined hardwood sulfite pulp having a screened Kappa number of 70.5 was delignified using oxygen and an alkali dosage of 10.0% by weight NaOH based on oven dry pulp. The pulp was placed in a horizontal tube oxygen reactor in a compacted form similar to the state of the pulp as it is discharged from a thick stock pump. The consistency of the pulp was 15% solids. The delignification reaction was carried out for 20 minutes at a temperature of 120° C. and a total pressure of 150 psig. In Run 2-A there was no agitation of the pulp. In Run 2-B, the pulp was loosened by hand before being placed in the reactor. In Run 2-C, the pulp was loosened by hand and was agitated during the entire reaction time by means of a modified screw design in accordance with the present invention, namely a horizontal shaft equipped with paddles turning at 1 rpm. The results are reported in Table II below.

TABLE II

| | Kappa No. | Change in Kappa No. | Yield (%) |
|---|---|---|---|
| Starting pulp | 70.5 | — | — |
| Run 2-A | 43.0 | 27.5 | 76.3 |
| Run 2-B | 32.3 | 38.2 | 80.6 |
| Run 2-C | 20.5 | 50.0 | 76.6 |

This example illustrates the importance of loosening the pulp to improve primary oxygenation and shows that agitation of the pulp using a low speed shaft equipped with agitation means serves to increase greatly the rate of delignification.

EXAMPLE III

The pulp of Example II was delignified under the same reaction conditions (10% NaOH, 120° C., 20 minutes, 150 psig) except that a pulp consistency of 25% was used instead of 15%. The pulp was loosened before being placed in the reactor, but no agitation was used during the run. The results are reported in Table III below.

TABLE III

| | Kappa No. | Yield (%) | Viscosity (cps) |
|---|---|---|---|
| Starting Pulp | 70.5 | — | — |
| Run 2-C | 20.5 | 76.6 | 17.2 |
| Run 3 | 17.6 | 76.2 | 11.4 |

As can be seen, in contrast to the teachings of the prior art, a high rate of oxygen delignification, as shown by the respective Kappa numbers, at medium consistency can be achieved utilizing the process of the present invention. Moreover, the process of the present invention can produce a delignified pulp having a superior viscosity. Since pulp viscosity is a rough measure of pulp strength, a higher viscosity indicates a higher pulp strength.

EXAMPLE IV

A sample of repulped corrugated paperboard clippings having a Kappa number of 87.3 and a Photovolt brightness of 13 was delignified using oxygen and alkali under the following reaction conditions: 12.0% pulp consistency, 15.0% by weight NaOH dosage based on oven dry pulp, 120° C., 110 psig total pressure, and 15 minutes reaction time. In the first run (Run 4-A), the pulp was loosened by hand before being placed in the reactor but there was no agitation of the pulp during the reaction. Run 4-B was made under the same reaction conditions except that the pulp was agitated using a modified screw design in accordance with the present invention, namely a horizontal shaft equipped with paddles turning at 3 rpm during the entire reaction time. Run 4-C was made under the same reaction conditions except that the pulp was agitated using a horizontal shaft equipped with paddles turning at 20 rpm for the first two minutes and then 3 rpm for the final 13 minutes of the reaction. The results are reported in Table IV below.

TABLE IV

| | Kappa No. | Brightness |
|---|---|---|
| Starting pulp | 87.3 | 13 |
| Run 4-A | 69.1 | 13 |
| Run 4-B | 58.2 | 14 |
| Run 4-C | 54.6 | 17 |

As can be seen, practice of the present invention results in a greater degree of delignification and a brighter pulp than previous methods.

While the apparatus and methods herein described constitute preferred embodiments of the invention, it is to be understood that the invention is not limited to these precise apparatus and methods, and that changes may be made in either without departing from the scope of the invention, which is defined in the appended claims.

What is claimed is:

1. A process for the continuous oxygen delignification of medium consistency pulp comprising the steps of:

a. introducing pulp at a consistency of from 8 to 20% and alkaline materials into a first reaction zone and maintaining the consistency of the pulp at between 8% to 20% throughout the first and subsequent reaction zones, b. introducing gaseous oxygen into said first reaction zone to delignify said pulp and maintaining the oxygen partial pressure in the first and subsequent reaction zones from about 30 to 200 psig, c. agitating the mixture of the pulp gaseous, oxygen, and alkaline materials with a screw conveyor extending along the length of said first zone operated at from 10 to 200 rpm, and d. passing said mixture into one or more subsequent substantially horizontal reaction zones and retaining the pulp in said one or more zones for a time sufficient for further delignification to occur while agitating said pulp with a screw operating at from 0.5 to 5 rpm.

2. The process of claim 1 in which said screws extend the entire length of the reaction zones and have modified flights.

3. The process of claim 1 in which the temperature in said reaction zones is maintained at between about 80° and 160° C.

4. The process of claim 3 in which steam is injected into the pulp prior to its introduction into said first reaction zone.

5. The process of claim 1 in which a thick stock pump is used to introduce the pulp into said first reaction zone.

6. The process of claim 1 in which said alkaline materials are selected from the group consisting of sodium hydroxide, sodium carbonate, sodium borate compounds, ammonia, oxidized kraft white liquor, or mixtures thereof.

7. The process of claim 6 in which the charge of alkaline materials present in the first reaction zone is from 1% to 20% by weight, calculated as $Na_2O$ on an oven dry basis of raw materials.

8. The process of claim 7 in which said alkaline materials are introduced at the top of said first reaction zone at points along the length thereof.

9. The process of claim 1 in which at least a portion of said alkaline materials are added to the pulp prior to its introduction into the first reaction zone.

10. The process of claim 1 in which the consistency of the pulp is from 10 to 15% throughout said first and subsequent reaction zones.

11. The process of claim 1 including the step of, e. passing said mixture into a nonagitated vertical retention column for completion of delignification.

12. The process of claim 1 in which the diameter of said first reaction zone is less than the respective diameters of subsequent reaction zones.

13. The process of claim 1 in which the total retention time for the total retention time for said pulp in said first and subsequent reaction zones is from about 5 to 120 minutes.

* * * * *